United States Patent [19]

Crane et al.

[11] Patent Number: 5,022,964

[45] Date of Patent: Jun. 11, 1991

[54] NONWOVEN FIBROUS WEB FOR TOBACCO FILTER

[75] Inventors: L. Paul Crane, Simsbury; H. Clark Lind, Enfield, both of Conn.; Martine E. Frederix, Charlotte, N.C.

[73] Assignees: The Dexter Corporation, Windsor Locks, Conn.; Hoechst Celanese Corporation, Somerville, N.J.

[21] Appl. No.: 362,054

[22] Filed: Jun. 6, 1989

[51] Int. Cl.[5] ..... D21F 11/12

[52] U.S. Cl. ..... 162/146; 162/157.2; 162/157.6; 162/157.7; 131/341; 131/343; 131/345

[58] Field of Search ..... 162/146, 157.2, 157.6, 162/157.7; 156/167; 493/42, 43; 131/332, 345, 343, 341

[56] References Cited

U.S. PATENT DOCUMENTS

| | | | |
|---|---|---|---|
| 2,887,429 | 5/1959 | Griggs et al. | 162/148 |
| 2,988,469 | 6/1961 | Watson | 264/2 |
| 3,007,840 | 11/1961 | Wilcox | 162/101 |
| 3,180,911 | 4/1965 | Muller | 264/119 |
| 3,342,921 | 9/1967 | Brundige et al. | 264/200 |
| 4,040,856 | 8/1977 | Litzinger | 106/170 |
| 4,047,862 | 9/1977 | Keith | 425/8 |
| 4,160,059 | 7/1979 | Samejima | 210/504 X |
| 4,192,838 | 3/1980 | Keith et al. | 264/10 |
| 4,274,914 | 6/1981 | Keith et al. | 162/109 |
| 4,283,186 | 8/1981 | Keith et al. | 493/42 |

FOREIGN PATENT DOCUMENTS

| | | |
|---|---|---|
| 2354060 | 1/1978 | France . |
| 53384 | 1/1974 | Japan . |

*Primary Examiner*—David A. Simmons
*Assistant Examiner*—Thi Dang
*Attorney, Agent, or Firm*—Chilton, Alix & Van Kirk

[57] ABSTRACT

A nonwoven fibrous web material that contains cellulose ester fibers, cellulose ester fibrets and a minor amount of activated fusible fibers uniformly dispersed throughout is particularly well suited as a filter media. The activated fusible fibers are effective for retaining within the filter web any particulate material resulting from corrugation without adversely affecting the filtration efficiency of the cellulose ester fibers and fibrets. Alternatively, the fibrous web material may include an effective amount of natural cellulosic fibers.

12 Claims, 4 Drawing Sheets

NONWOVEN FIBROUS WEB FOR TOBACCO FILTER

TECHNICAL FIELD

The present invention relates to a nonwoven fibrous web material and more particularly to a fribrous web that is uniquely well suited for filtering tobacco smoke and the like. It further relates to filters that efficiently remove the constituents of tobacco smoke, in particular tar and nicotine, without releasing dust-like particles during corrugation or exhibiting dimensional instability. The present invention also relates to processes for making such materials and filters.

The principle use contemplated for the material of this invention is as a filter for the removal of respirable particles. When so employed, the filter may be used in conjunction with cigarette or other smoking articles such as a pipes or cigars. It will be obvious, however, that the filter material may also be advantageously utilized for other filter applications.

BACKGROUND OF THE INVENTION

Many types of filter materials have been proposed for decreasing the amount of certain ingredients of tobacco smoke reaching a smoker's respiratory system. When used for filtering tobacco smoke, the filter material should not distort the taste of the smoke by adding a taste of its own and should be capable of inexpensive fabrication so as not to make the ultimate price of the smoking article too costly.

While a wide variety of fibrous materials have been employed as filter material, only paper and cellulose acetate filters have met with any significant commercial acceptance. Paper filters are usually corrugated and condensed into a rod form for attachment to a cigarette. Unfortunately, they tend to adversely affect the taste and odor of the delivered smoke stream and, due to their high moisture absorbency, tend to collapse during use since the compressibility of moist paper filters at a given pressure drop is generally greater than other conventionally used filters of comparable weight.

Cellulose acetate is conventionally used in the form of a tow of continuous filaments. These filters overcome all the aforementioned disadvantages of paper filters while admirably meeting the requirements of good draw and economy. As a result, a major portion of filter cigarettes utilize this type of material in spite of the fact that tow filters exhibit smoke removal efficiencies at a given draw that are relatively lower than that of paper filters.

An alternative method of utilizing cellulose acetate is the formation of nonwoven webs, or felted batts from staple fibers. Such fibrous structures lack dimensional stability and necessitate the use of binders to maintain the fibers in their desired array.

It also has been suggested in U.S. Pat. Nos. 4,192,838, 4,274,914 and 4,283,186 that cellulose acetate fibrets may be effective to hold the cellulose acetate fibers in the absence of a binder and still provide the desired high surface area for filtration. The patents indicate the use of binders decreases the surface area available for filtration, adds an undesirable taste to the filtered smoke and represent a limiting factor in the speed of filter manufacture because of the time necessary to attain complete bonding. However, the binder free materials have a tendency to break when run through the corrugating and plug forming machinery and as a result, the components of the web are not securely anchored within the webs, exhibiting a significant solid particulate or "dusting" problem.

SUMMARY OF THE INVENTION

It is therefore an object of the present invention to provide a sheet-like structure having the desired high filtration characteristics and dust-free character of the bonded material. Included in this object is the provision for a nonwoven web material having not only excellent filtration characteristics but also reducing the fly or "dusting" particles produced during the manufacture of the filter.

Another advantage of the present invention is the provision for a nonwoven web material of the type described that permits the uniform incorporation of a minor amount of natural cellulosis fibers, when desired, to adjust the strength characteristics of the final product and the filtration capabilities of all fibers without adversely impacting on the resultant taste detected by the user.

A further advantage of the present invention is the provision for achieving the foregoing features while providing dimensional stability without limiting the speed of filter manufacture.

Other advantages will be in part obvious and in part pointed out more in detail hereinafter.

These and related advantages are achieved in accordance with the present invention by providing a nonwoven fibrous web material particularly well suited for use as a filter for filtering tobacco smoke comprising cellulose ester fibers, cellulose ester fibrets and a minor amount of activated fusible fibers uniformly dispensed throughout the cellulose ester fibers and fibrets. The activated fusible fibers are effective for retaining particulate material within the web without adversely affecting the filtration efficiency of the cellulose ester fibers and fibrets. In an alternative embodiment the web material may include small amounts of natural cellulosic fibers to adjust the strength and processability of the web material, particularly the formation thereof, without adversely impacting on the taste of the tobacco smoke.

A better understanding of this invention will be obtained from the following description of the filter material and the process for its manufacture including the several steps of that process and the relation of one or more of such steps with respect to each of the others, and the article of manufacture possessing the features, characteristics, properties, and relation of elements described and exemplified herein.

DESCRIPTION OF A PREFERRED EMBODIMENT

Figure 1:
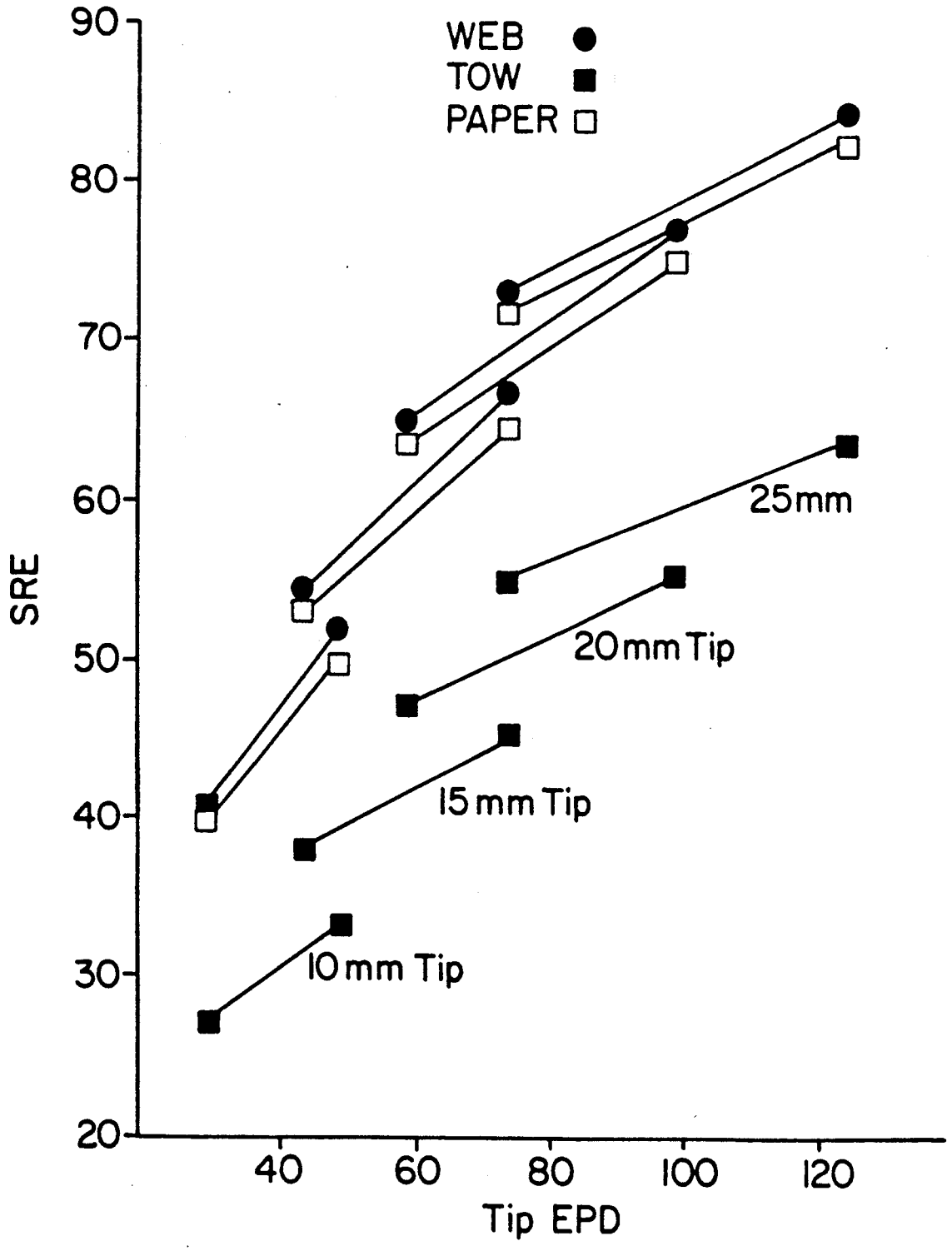
FIG. 1 is a graph showing the wet smoke removal efficiency as a function of the filter tip equivalent pressure drop.

The new and improved filter material of the present invention is produced in accordance with conventional paper-making techniques in order to obtain nonwoven fibrous web material of sufficient structural integrity to withstand the stresses encountered in handling the material on automated machinery. Thus the nonwoven fibrous web material is comprised of water dispersible fibers well suited to wet papermaking operations wherein the fibers are initially dispersed at very low consistencies within large amounts of an aqueous dispersing medium and subsequently deposited on a fiber collecting wire in the form of a thin continuous nonwoven web.

In accordance with the present invention the major fibrous components of the web material are those set forth in U.S. Pat. No. 4,274,914, namely cellulose ester fibers and cellulose ester fibrets, the latter constituting from 5 to 35 percent by weight of the total fiber content.

The cellulose ester staple fibers employed are desirably fibrous material of the conventional type having a fiber length of from about ⅛ to ⅝ inch and a denier per filament of from about 1.0 to 8.0. It is preferred that the staple have a length of from ¼ to ⅜ inch and a denier per filament of from about 1.0 to 3.0. The fiber cross-section may be the normal form produced by extrusion through a round orifice or have other cross sections produced by extrusion through non-circular orifices.

The cellulose ester staple may be one or more selected from the group of cellulose acetate, cellulose propionate, cellulose butyrate, cellulose benzoate, cellulose acetate formate, cellulose acetate propionate, cellulose acetate butyrate and the like. The esters may be ripened and acetone soluble, such as conventional cellulose acetate, or may be substantially fully esterified, i.e., contain fewer that 0.29 free hydroxyl groups per anhydroglucose unit, such as cellulose triacetate. The preferred cellulose ester staple material is cellulose acetate.

The fibrets utilized are also cellulose esters, preferably cellulose acetate, but have a structure similar to wood pulp. That is, they contain a microfibrillar structure comprised of microfibrils exhibiting a high surface area, i.e. approximately 20 square meters per gram, as contrasted with the smooth rod-like fibers of conventional synthetic man-made organic fibers. The pulp-like fibrets can be dispersed to achieve excellent uniform distribution throughout the dispersing medium and the resultant sheet product. Whereas ordinary cellulose acetate filaments have a surface area of about 0.25 square meters per gram, this high surface area cellulose ester fibrillar material generally has a surface area in excess of 1.0 square meter per gram and typically greater than 5.0 square meters per gram, a length of less than 1,000 microns and preferrably less than 220 microns, and a diameter of from about 0.5 to 50 microns but typically less than 5 microns.

As mentioned the amount of fibrets used in the fiber furnish is from about 5 percent to about 35 percent by weight based on the weight of the finished sheet. It is preferred, however, that the filter material comprises from about 10 percent to 20 percent of the fibrets.

As indicated hereinbefore, binder-free filter material comprised of cellulose ester fibers and fibrets has a tendency toward breakage when run through the corrugating machinery used to form the filter plugs, causing not only processing problems but also resulting in the presence of unacceptable levels of dusting caused by loose particulate material in the filter. In accordance with the present invention a significant improvement in strength and particle retention can be achieved without adversely impacting on the filtering characteristics of the cellulose acetate filter. This is obtained by incorporating into the fibrous web material a minor amount of a fusible fiber component. The fusible fibers will not only impart greater dimensional stability and strength but will do so without reducing the filtration efficiency of the cellulose ester fibers and fibrets. The fusible fibers of the present invention provide uniformly dispersed, discrete linkages between the fibers and fibrets thereby achieving improved strength while retaining the beneficial and filtration efficiency characteristics of the fibrous material.

The term "fusible" fibers as used herein includes not only fibers of thermoplastic material that soften or melt at relatively low temperatures, i.e. below 200° C., such as the vinyl acetate, vinyl chloride copolymer commonly known as "vinyon" but also bicomponent fibers and the thermoplastic fibrils or fibrids of the type conventionally found in synthetic wood pulp. The synthetic pulp is a thermoplastic polyolefin material, such as polyethylene, polypropylene and mixtures thereof. These highly fibrillated materials exhibit of melting point in the range of 135° to 170° C.

The preferred fusible material is a polyvinyl alcohol fiber that exhibits an ability to soften and flow in water at temperatures as low as 150° F. Typical of the polyvinyl alcohol fibers is the material sold under the tradename "Type SLM" by Unitika Kasei, Ltd of Japan. That fibrous material consisting of about 45% polyvinyl alcohol, 10% sodium sulfate and 35% water. The company's "Type F" material that contains 65% polyvinyl alcohol and 35% water may also be used. As the temperature reaches 150° F. in the drying section of the papermaking apparatus, these fibers become somewhat soluble in that they begin to absorb water and swell. The softened fibers then adhesively cling or bond to the cellulose ester fibers and fibrets without coating those materials.

In the case of the water insoluble heat fusible fibers, the bond is not formed until the sheet is dry and the web temperature is raised to the fusion temperature of the fibers. The fibers then flow as does the polyvinyl alcohol to form adhesive bonds which hold the components together in web form and minimized dust release during corrugation.

The amount of fusible fibers incorporated into the fibrous filter web material is less than about 15% by weight and typically falls within the range of about 2–10% by weight with consistently good results being obtained at levels of about 4–6% by weight.

As an alternative and in order to enhance both web strength and the web forming operation, natural cellulosic fiber also may be added to the fiber furnish prior to web formation. These fibers include bleached and unbleached Kraft, hemp, jute, abaca and other wood fibers. The amount of natural fiber is usually less than 20% by weight and typically falls in the range of 8–15% with about 10% being preferred.

The staple fibers, fibrets and fusible fibers are thoroughly mixed and uniformly distributed throughout the fiber slurry. This may be accomplished by stirring or mixing either manually or with any conventional mixing apparatus.

The slurry is deposited on conventional paper-making apparatus to form a sheet-like material which has utility as a filter material such as for instance in sheet form for use in face masks and respirators or in corrugated and condensed form for use as a cigarette filter. Cigarette filter plugs produced from corrugated filter material of this invention exhibit equal or higher filtration efficiencies at a given pressure drop than plugs made without the fusible fibers.

Although substantially all commercial paper making machines, including rotary cylinder machines may be used, it is desirable where very dilute fiber furnishes are employed to use an inclined fiber collecting wire, such as that described in U.S. Pat. No. 2,045,095 issued to Fay H. Osborne on June 23, 1936. The fibers flowing from the headbox are retained on the wire in a random, three-dimensional network or configuration with slight orientation in the machine direction while the aqueous dispersant quickly passes through the wire and is rapidly and effectively removed.

The resultant sheet-like material is then passed to the drier section where the fusible fibers are activated to anchor and retain the components within the web. The dried web preferably has a sheet weight of from 20 to 40 grams per square meter, a surface area in excess of 1 square meter per gram and a sheet breaking strength of from 200 to 1,000 g/25 mm. The filter material of this invention is further characterized by a thickness in the range of 95–125 microns, a surface area of between about 1 square meter per gram and about 5 square meters per grams and a porosity $\Delta P$ through a one inch diameter circular sheet of between about 1 mm and about 70 mm, at a flow rate of 200 cc per minute. It is preferred, however, that the filter material have a surface area of between about 2 square meters per grams and about 5 square meters per gram.

The dried sheet may be used immediately or collected in the form of a supply roll. The web can then subsequently be passed into the nips of a pair of driven, grooved, corrugating rolls. The corrugating rolls produce folds and grooves and partial tears longitudinal to the direction of travel of the sheet material. The corrugating equipment is directly linked to a rod maker, well known in the art, where a cylindrical filter rod is formed. The rod, when cut into lengths suitable for a tobacco smoke filter, exhibits a draw, measured as the air pressure drop across the filter, in the range of 30 to 200 millimeters of water at a flow of 17.5 ml/second for a 20 millimeter length of filter. This process is the same as described in U.S. Pat. No. 4,283,186 which is incorporated herein by reference.

The web disclosed herein when formed into cigarette filters has a greater removal efficiency for such materials as nicotine, particulate matter (tar), and water than equivalent filters made of cellulose acetate tow. In Table I, cellulose acetate tow (Tow), the cellulose acetate web of the present invention (Web) and paper are compared at an equivalent pressure drop of 75 mm. The tar removal efficiency (TRE) is a percent figure as defined by the Federal Trade Commission as are the smoke, water and nicotene removal efficiencies, indicated by SRE, WRE and NRE, respectively.

TABLE I

| | Tow | Web | Paper |
|---|---|---|---|
| Removal Efficiency (%) | | | |
| TRE | 44.32 | 64.42 | 58.75 |
| SRE | 50.11 | 69.88 | 68.11 |

TABLE I-continued

| | Tow | Web | Paper |
|---|---|---|---|
| WRE | 63.36 | 82.21 | 88.21 |
| NRE | 38.49 | 60.14 | 58.57 |
| Delivered Components (mg/cigarette) | | | |
| Dry Tar | 15.59 | 9.96 | 11.55 |
| CPM* | 21.95 | 13.25 | 14.03 |
| Water | 5.13 | 2.49 | 1.65 |
| Nicotine | 1.23 | 0.80 | 0.83 |
| Ratios | | | |
| T/N | 12.67 | 12.45 | 13.92 |
| T/W | 3.04 | 4.00 | 7.00 |

*Cambridge particulate matter.

A comparison of the removal efficiencies of the tow and web reveals a greater removal of all components by the web of the present invention. This means that less tar and nicotine are delivered to the smoker. However, less water is also delivered so the smoke is dryer. A comparison of removal efficiencies of the web and paper reveals a greater removal by the web of all components, except water, which means that less tar and nicotine are delivered to the smoker, but more water is delivered so the smoke is more moist. Moistness of cigarette smoke is a factor considered in smoker preference.

The ratios of tar to nicotine(T/N) and tar to water(T/W) are similar for both the tow and the web and both are lower than for paper filters. Since the web removes more tar, the ratio indicates an improvement by the web at equivalent tar delivery levels.

Figure 2:
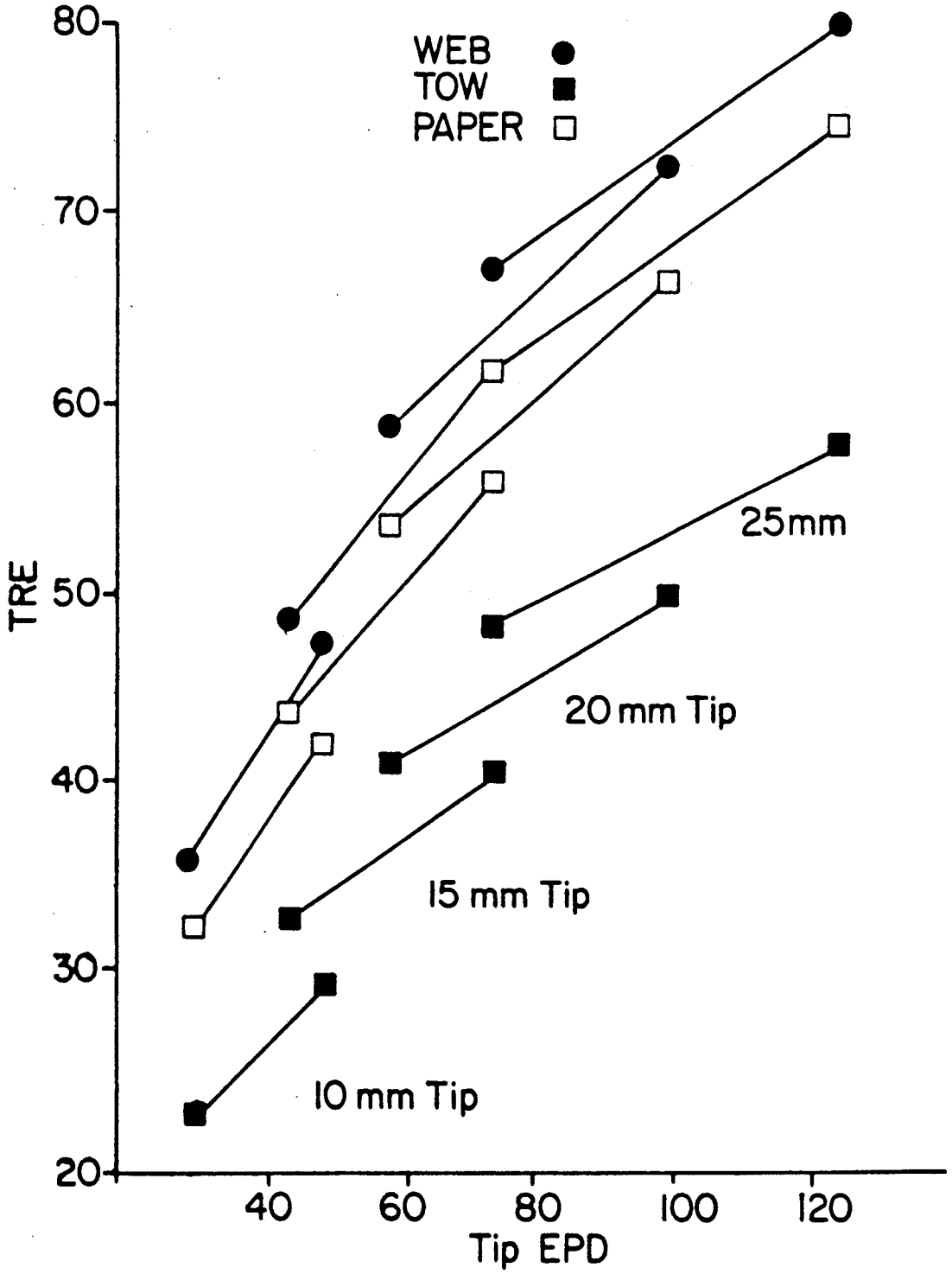
FIG. 2 is a graph showing the tar removal efficiency as a function of the filter tip equivalent pressure drop.

Referring now to FIGS. 1 and 2, a further comparison of tow, paper, and the web of the present invention is illustrated. FIG. 1 shows the wet smoke removal efficiency for filters of different tip lengths at equivalent pressure drop (EPD) levels while FIG. 2 is a similar graph for dry tar removal efficiency. In both FIGS. 1 and 2, the filters are non-ventilated and the webs of the present invention are shown to be superior to tow at the same filter length and pressure drop.

Figure 3:
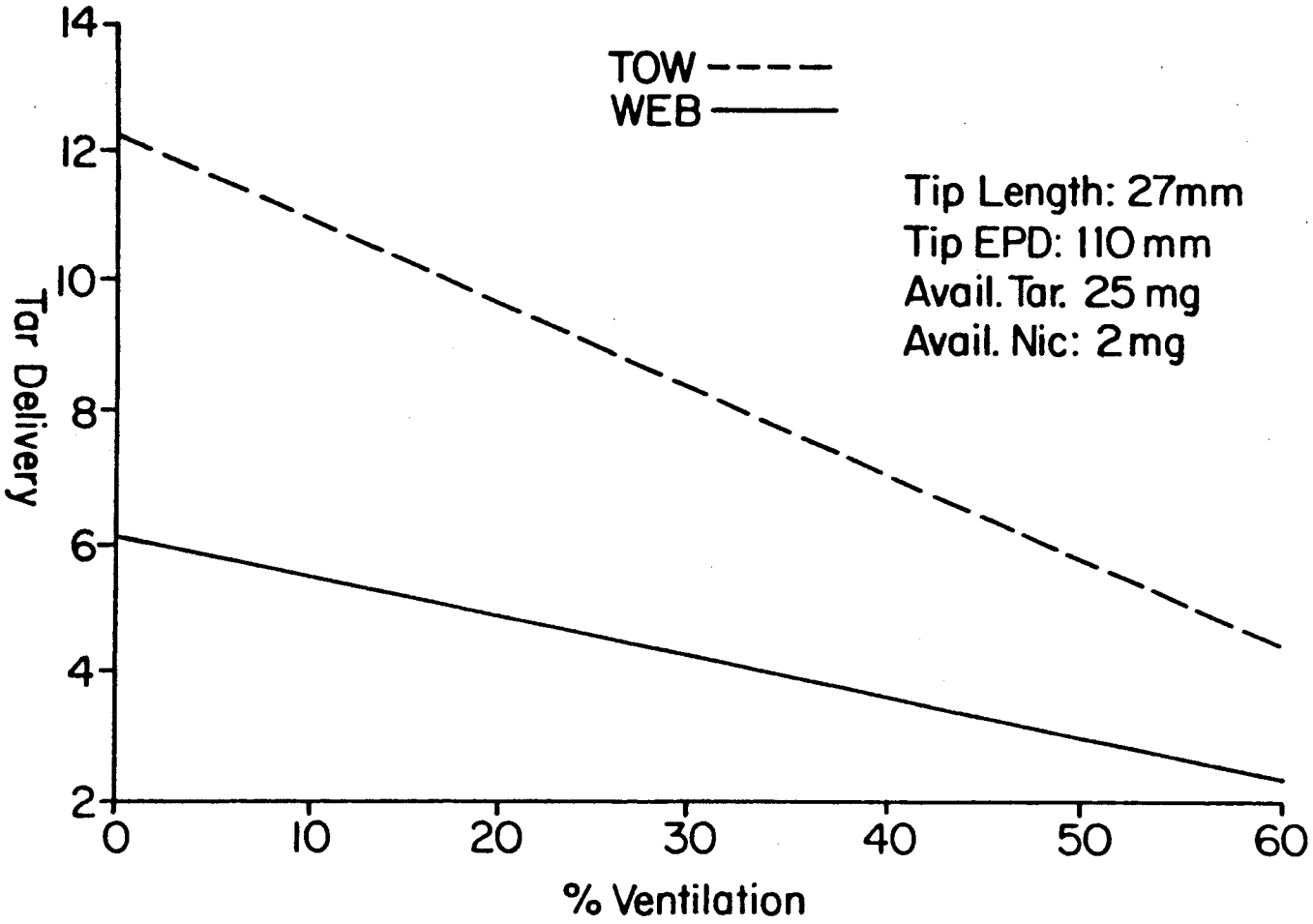
FIG. 3 is a graph showing the tar delivery as a function of percent ventilation.
Figure 4:
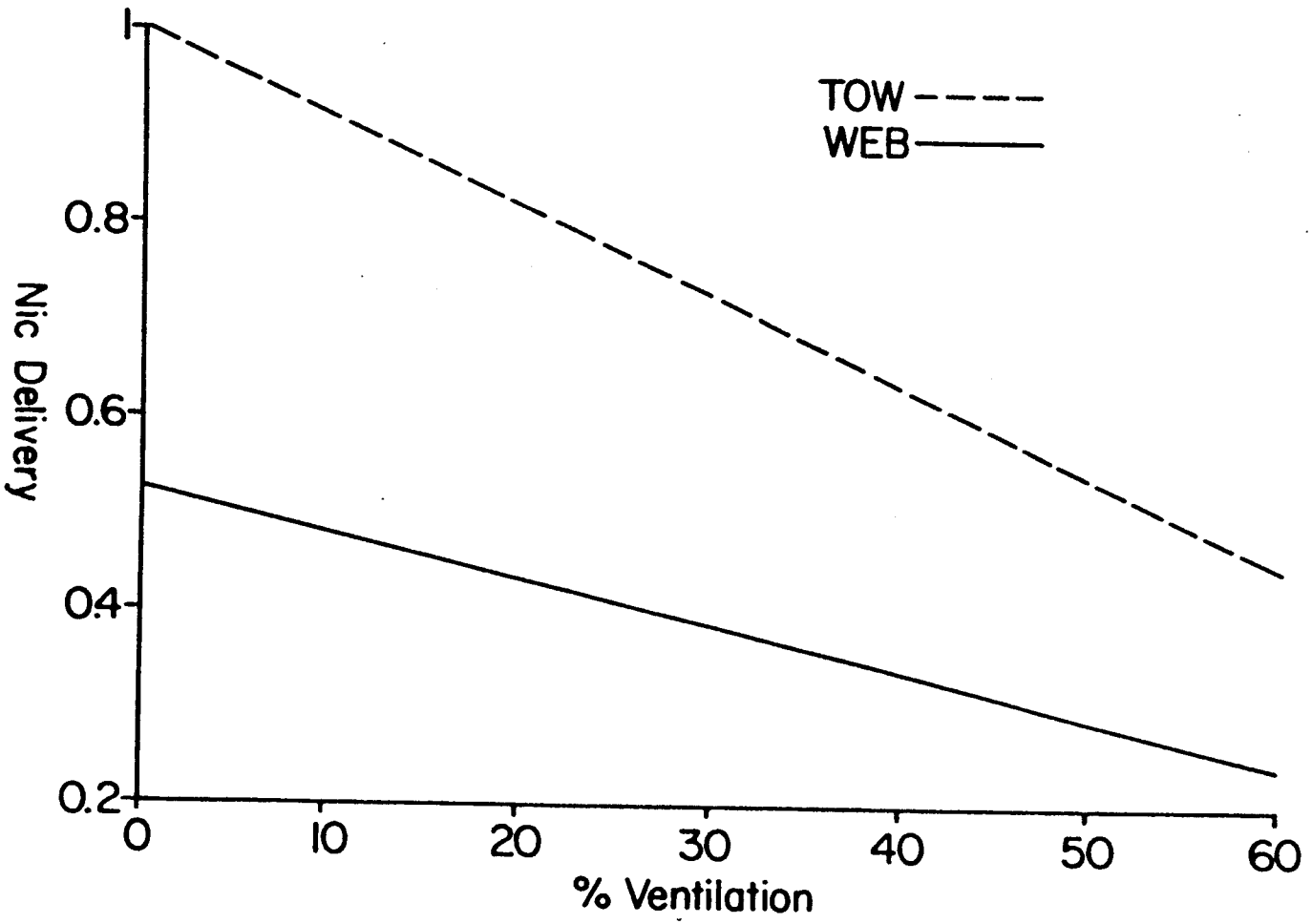
FIG. 4 is a graph showing the nicotine delivery as a function of percent ventilation.

Referring to FIGS. 3 and 4, a comparison of ventilated web and tow filters is illustrated. FIG. 3 shows tar delivery at different levels of ventilation while FIG. 4 shows nicotine delivery at the same levels. In both Figures it can be seen that the tar and nicotine are substantially lower for the web filters than for the tow filters.

A comparison of the web made according to the instant invention with the web disclosed in U.S. Pat. No. 4,274,914 shows that the addition of the fusible fibers has no appreciable effect on removal efficiencies. The instant web exhibits a smoke removal efficiency of about 65% and a tar removal efficiency of about 69% at 20 mm lengths and a pressure drop of 60 mm $H_2O$. Table II of U.S. Pat. No. 4,274,914 reveals comparable values of 68% and 64.9%, respectively.

The following examples are given in order that the effectiveness of the present invention may be more fully understood. These examples are set forth for the purpose of illustration only and are not intended in any way to limit the practice of the invention. Unless otherwise specified, all parts are given by weight.

EXAMPLE 1

A fiber furnish was prepared having a fiber content of 76 percent cellulose acetate fibers with a length of ¼ inch and a denier per filament of 1.8, 20 percent cellulose acetate fibrets and 4 percent polyvinyl alcohol fibers having a length of 3 mm and a denier per filament of 1.0 (Unitika Type SML). Using an inclined wire papermaking machine, a web was formed and conveyed to the drier section where it passed over steam heated drier drums having a surface temperature in excess of 200° F. The resultant web material had a basis weight of 33.6 g/m$^2$, a thickness of 104 microns and an air flow of 86 l/m/100 cm$^2$. It exhibited a tensile strength of 657 g/25 mm in the machine direction and 290 g/25 mm in the cross direction.

The web material was corrugated and formed into a cylindrical filter rod. The rod then was cut into suitable lengths for cigarette filter and tested. The results are set forth in Table I.

EXAMPLE 2

The procedure of Example 1 was followed except that the amounts of cellulose acetate fibers were reduced to 72 percent and the amount of polyvinyl alcohol fibers were increased to 8 percent. Although the resultant sheet material exhibited slightly greater tensile strength characteristics, its performance as a filter plug was substantially unchanged over the filter of Example 1.

EXAMPLE 3

The procedure of Example 1 was repeated except that the fiber furnish was changed primarily by the incorporation of natural cellulosic fibers. Table II sets forth the fiber composition and tests results for three different web materials.

TABLE II

| | WEB A | WEB B | WEB C |
|---|---|---|---|
| Fiber | | | |
| Cellulose acetate fiber, % | 76 | 76 | 66 |
| Cellulose acetate fibret, % | 10 | 10 | 15 |
| Polyvinyl alcohol, % | 4 | 4 | 4 |
| Harwood kraft, % | 10 | — | 5 |
| Softwood kraft, % | — | 10 | 10 |
| Properties | | | |
| Basis Wt. g/m$^2$ | 32.0 | 31.4 | 29.9 |
| Thickness, % | 99 | 107 | 104 |
| Air flow, l/m/100 cm$^2$ | 261 | 416 | 205 |
| Tensile strength, MD | 740 | 913 | 1234 |
| Tensile strength, CD | 429 | 604 | 611 |

As can be seen the incorporation of natural cellulosic fibers significantly increased both the air flow and strength characteristics of the web materials. The increased levels of fibret in web C relative to webs A and B tended to reduce the air flow characteristics of the filter material.

As will be apparent to persons skilled in the art, various modifications, adaptations and variations of the foregoing specific disclosure can be made without departing from the teaching of the present invention.

We claim:

1. A nonwoven fibrous web material for use as a filter media comprising cellulose ester fibers, cellulose ester fibrets and a minor amount of activated fusible fibers uniformly dispersed throughout the cellulose ester fibers and fibrets, said activated fusible fibers being present in an amount effective for retaining particulate material within the web material without substantially adversely affecting the filtration efficiency of the cellulose ester fibers and fibrets.

2. The fibrous web material of claim 1 wherein the fusible fibers are heat activated to effectively bond adjacent ester fibers and fibrets during drying of the web.

3. The fibrous web material of claim 1 wherein the fusible fibers are selected from the group consisting of polyvinyl alcohol, vinyl copolymers, polyethylene, polypropylene, bicomponent fibers and mixtures thereof.

4. The fibrous web material of claim 1 wherein the fusible fibers are softened and swellable upon activation to adhere to adjacent fibers and fibrets.

5. The fibrous web material of claim 1 wherein the fusible fibers are polyvinyl alcohol fibers.

6. The fibrous web material of claim 1 wherein the fusible fibers constitute less than about 15% by weight of the fibrous web.

7. The fibrous web material of claim 1 wherein the fusible fibers constitute at least about 2 percent by weight of the web material.

8. The fibrous web material of claim 1 wherein the cellulose ester fibers and fibrets are selected from the group consisting of cellulose acetate, cellulose propionate, cellulose triacetate, cellulose benzoate, cellulose acetate butyrate, cellulose acetate formate, cellulose acetate propionate, benzyl cellulose and mixtures thereof.

9. The fibrous web material of claim 1 wherein the cellulose ester fibers are cellulose acetate fibers, the fibrets constitute 5–35 percent by weight of web material and the fusible fibers constitute about 4–10 percent by weight.

10. The fibrous web material of claim 1 including an effective amount up to 20% by weight of natural cellulosic fibers.

11. A tobacco filter made from the fibrous web material of claim 1.

12. A tobacco filter made from the fibrous web material of claim 9.

* * * * *